US006238303B1

(12) United States Patent
Fite

(10) Patent No.: US 6,238,303 B1
(45) **Date of Patent: *May 29, 2001**

(54) GOLF PUTTER WITH ADJUSTABLE CHARACTERISTICS

(76) Inventor: John Fite, 5295 Broadway Ter., Oakland, CA (US) 94618-1498

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/758,788

(22) Filed: Dec. 3, 1996

(51) Int. Cl.[7] ..... A63B 53/04
(52) U.S. Cl. ..... 473/342; 473/288; 473/325
(58) Field of Search ..... 473/342, 287, 473/288, 340, 290, 325, 334, 335, 324

(56) References Cited

U.S. PATENT DOCUMENTS 3,848,737 * 11/1974 Kenon ..... 473/288 X
4,121,832 * 10/1978 Ebbing ..... 473/288 X
4,156,526 * 5/1979 Huggins et al. ..... 473/329
4,199,144 * 4/1980 Skelly ..... 473/340 X
4,253,666 * 3/1981 Murphy ..... 473/288
4,422,638 * 12/1983 Tucker ..... 473/329
4,884,808 * 12/1989 Retzer ..... 473/288
5,083,778 * 1/1992 Douglass ..... 473/329
5,332,214 * 7/1994 Tucker, Sr. ..... 473/329
5,407,196 * 4/1995 Busnardo ..... 473/340 X
5,437,447 * 8/1995 Rigutto ..... 473/288 X
5,445,386 * 8/1995 Marshall ..... 473/340 X
5,458,332 * 10/1995 Fisher ..... 473/340 X
5,464,212 * 11/1995 Cook ..... 473/340 X
5,531,439 * 7/1996 Azzarella ..... 473/340 X
5,542,675 * 8/1996 Micciche et al. ..... 473/342 X
5,690,562 * 11/1997 Sturm ..... 473/335 X

* cited by examiner

*Primary Examiner*—Raleigh W. Chiu
(74) *Attorney, Agent, or Firm*—Knobbe, Martens, Olson & Bear, LLP

(57) ABSTRACT

A golf putter having a removable ball striking insert received in a recess formed in the front surface of a putter body. Ball striking inserts having various weight, texture and hardness characteristics may be interchanged with the putter body in order to provide different putting characteristics to the golf club.

6 Claims, 3 Drawing Sheets

GOLF PUTTER WITH ADJUSTABLE CHARACTERISTICS

BACKGROUND OF THE INVENTION

This invention relates to golf clubs in general and, more particularly, to golf clubs for putting.

One of the more difficult aspects of mastering the game of golf is developing and maintaining an effective putting technique. Effective putting depends upon many factors—some objective, some subjective—including the speed of the greens on any given day and at any given time, and the "feel" of the golf putting club. Through the years, golf putters of many different, widely varying designs have been produced, from simple blade shapes through mallet head bodies and blade putters having compound curved rear surfaces. Individual golfers have developed individual preferences for different putter shapes and styles, with these preferences changing from time to time. Consequently, most devotees of the sport of golf accumulate several putters over time, with each putter providing a different "feel" for the individual golfer. Not only does this present a club storage problem for the individual golfer, but the requirement for a wide variety of different putters each providing different "feel" dictates that golf club retailers must carry in inventory a large number of different style putters in order to satisfy the needs of customers.

While golf putters are known which permit adjustment of the weight of the putter head by adding or removing internally located weights, and which enable adjustment of the loft of the striking surface, efforts to date to provide a golf putter with easily adjustable weight, striking surface texture and hardness have not met with success.

SUMMARY OF THE INVENTION

The invention comprises a golf putting club which provides simple and rapid adjustment of the putter weight, striking surface texture and hardness so that a golfer may alter the "feel" of the club to suit the putting green characteristics, the type of ball being played and the player's putting style at any given time.

In its broadest aspect, the invention comprises a putter body having a shaft connection region and a ball striking surface, the ball striking surface having a recess formed therein to a predetermined depth; a shaft having an end secured to the shaft connection region; and a ball striking insert detachably mounted in the recess. The ball striking insert has length, width and depth dimensions closely matching those of the recess so as to form a striking face substantially co-planar with the ball striking surface of the putter body.

In one embodiment, the putter body includes a longitudinal axis with a stroke balance point at a predetermined location therealong, and the recess extends along the longitudinal axis in substantial equal and opposite directions from the stroke balance point. The stroke balance point may be centered along the longitudinal axis of the putter body, or may be offset from the lineal center of the longitudinal axis.

The putter body recess and the ball striking insert are both preferably rectangular in shape, with chamfered corner portions. A plurality of alternative mounting mechanisms are used to detachably mount the insert in the recess. One such mechanism includes a spaced pair of bores formed in the ball striking insert, a corresponding pair of fastener apertures formed in the putter body, and a pair of fasteners each removably secured in a different one of the fastener apertures and a corresponding one of the bores. The fastener bores may be internally threaded and the fasteners externally threaded so that the fasteners are threaded into the fastener bores. Alternatively, the fasteners may be spring friction fasteners releasably received within smooth walled fastener bores. In another mounting arrangement, the putter body is provided with one or two insert receiving slots adjacent the recess; and the ball striking insert has opposite end portions each engageable with a different one of the slots. In this embodiment, the ball striking insert may include a grip recess formed therein in a position accessible when the ball striking insert is mounted in the recess. Further, the putter body may be provided with a relieved portion adjacent the recess to facilitate access to the grip recess. In another mounting arrangement, the ball striking insert includes a spaced pair of studs, the putter body has a corresponding pair of stud apertures, and a pair of fasteners is releasably secured to the studs after they are manipulated through the stud apertures.

In another embodiment of the invention, the putter body may include first and second recesses formed in the ball striking surface in order to accommodate a pair of ball striking inserts. The first recess and the second recess are preferably spaced laterally along the ball striking surface and have substantially identical depth dimensions.

The putting characteristics of the golf club can be varied by using ball striking inserts of different weight, texture and hardness. The ball striking insert may be fabricated from a wide variety of materials, such as titanium, graphite, polytetrafluoroethylene (PTFE), copper, brass, plastics, aluminum and steel.

An indicium may be provided on the putter body at a location visible to the golfer in order to provide a visual indication of the location or position of the stroke balance point.

A point of sale package is provided to accommodate one or a plurality of the ball striking inserts. The container includes a base portion and means for removably retaining the ball striking inserts therein. Additionally, provision is made in the container for a journal card or booklet for preprinting information identifying the characteristics of the various ball striking inserts contained within the container, and for enabling the user to record personal entries memorializing experience gained with the ball striking inserts.

The invention enables a single putter to provide a wide variation in club "feel" by virtue of providing the removable ball striking inserts of different weights, textures and hardnesses.

For a fuller understanding of the nature and advantages of the invention, reference should be made to the ensuing detailed description, taken in conjunction with the accompanying drawings.

DETAILED DESCRIPTION OF THE PREFERRED EMBODIMENTS

Figure 1:
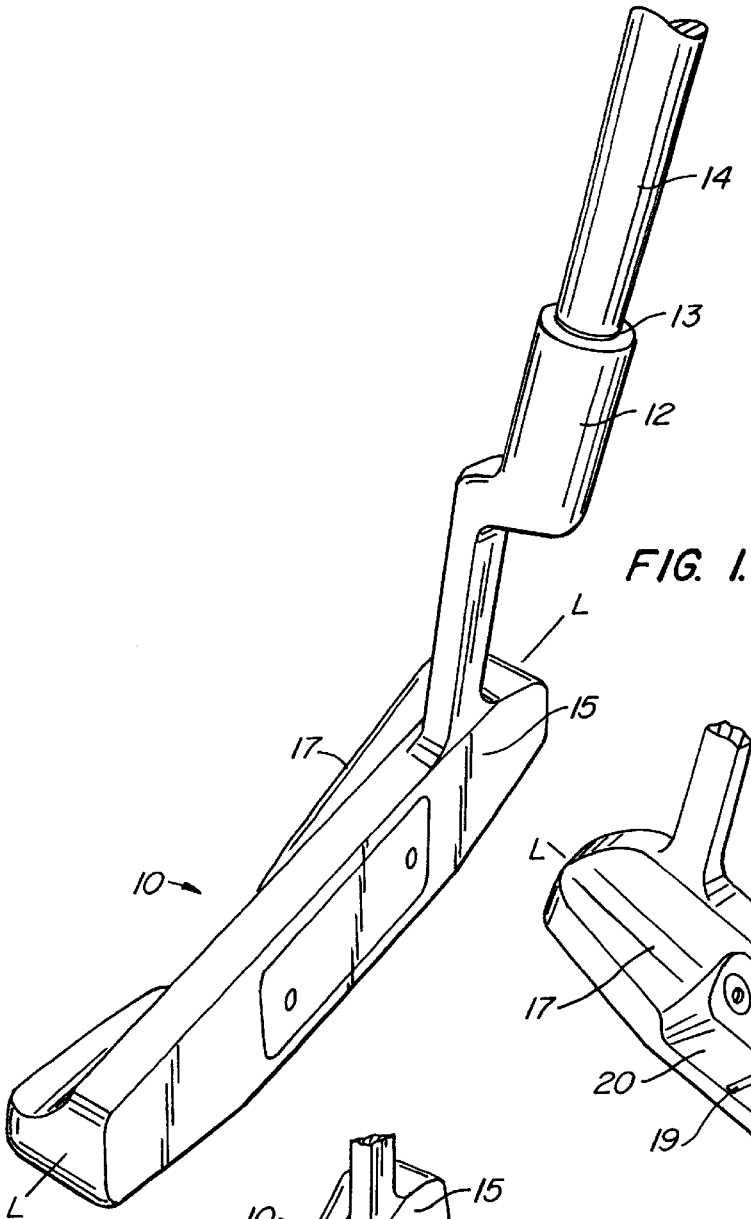
FIG. 1 is a perspective view of the golf club for putting of the present invention.
Figure 2:
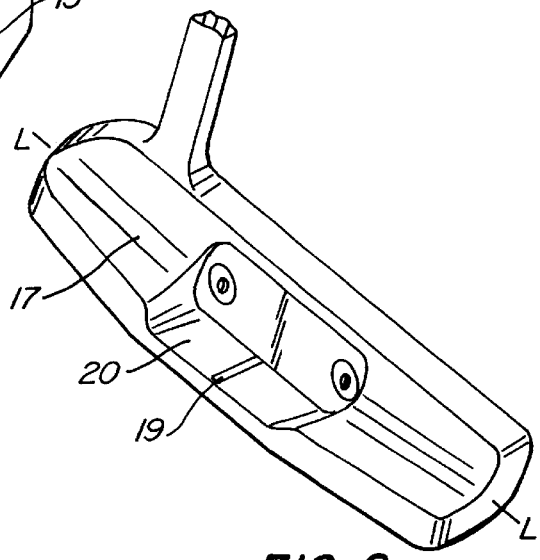
FIG. 2 is a perspective view of the golf putting club shown in FIG. 1 and illustrating the rear surface of the putter body.
Figure 3:
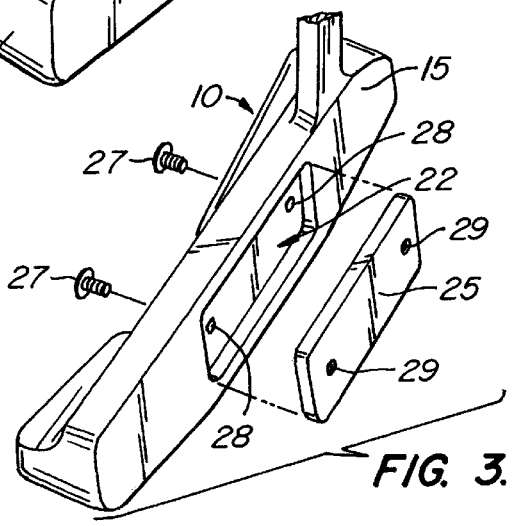
FIG. 3 is an exploded perspective view illustrating the detachable ball striking insert and fasteners.
Figure 4:
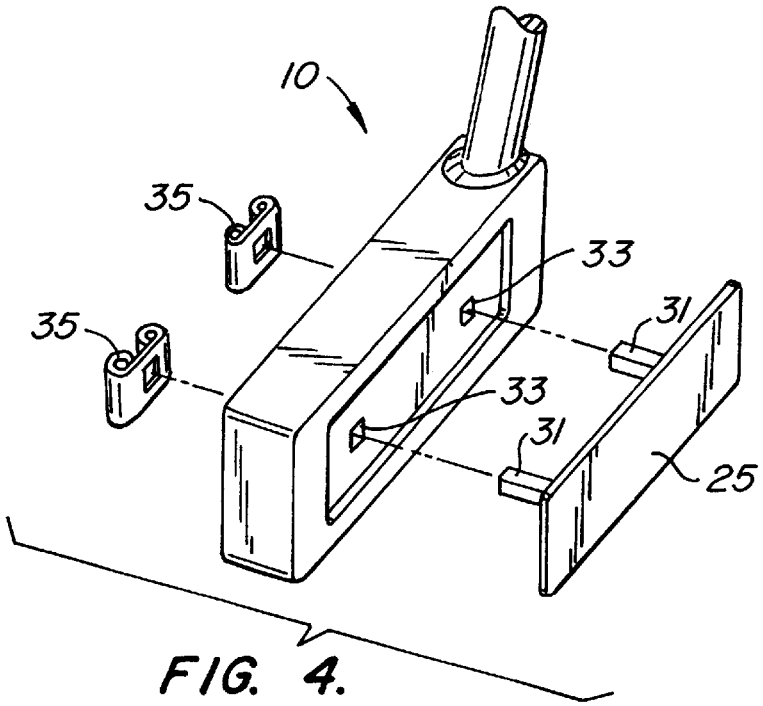
FIGS. 4–6 are exploded perspective views illustrating different insert mounting arrangements.

Turning now to the drawings, FIGS. 1–3 illustrate a golf putting club fabricated according to the invention. As seen in these figures, the club includes a putter body generally designated with reference numeral 10 and having a hosel portion 12 extending angularly upwardly and terminating in a shaft aperture 13. Secured within shaft aperture 13 is the lower end of a suitable golf club shaft 14 which is secured to hosel 12 in any suitable manner.

Putter body 10 has a front face 15 and a rear surface 17 having a compound curvature as shown. Putter body 10 has a longitudinal axis generally designated with a solid line denoted with reference character L—L. The stroke balance point or "sweet spot" along longitudinal axis L—L of putter body 10 is visually indicated by an indicium 19 in the form of a straight-lined groove formed in a ledge portion 20 of rear surface 17 of putter body 10.

A recess 22 is formed in the front surface 15 of putter body 10. In the embodiment of FIGS. 1–3, recess 22 is centered about the stroke balance point 19 along longitudinal axis L—L of putter body 10 and, in the preferred embodiment, recess 22 has a rectangular shape with chamfered corners. Removably secured within recess 22 is a ball striking insert 25 having length, width and depth dimensions closely matching those of recess 22 so that insert 25 forms a ball striking surface (when installed in recess 22) which is substantially co-planar with the surrounding portions of front surface 15. Ball striking insert 25 is removably secured to putter body 10 by means of threaded fasteners 27 which pass through through apertures 28 formed through putter body 10 in the vicinity of recess 22, fasteners 27 being threaded into threaded bores 29 formed in ball striking insert 25. While threaded bores 29 are illustrated as throughbores in FIG. 3, blind bores may be provided, if desired. The corners of ball striking insert 25 are chamfered to match the chamfers formed in the corner portions of recess 22.

Ball striking insert 25 may be fabricated from a wide variety of different materials having different weight, texture and hardness characteristics. Examples of some suitable materials are titanium, graphite, polytetrafluoroethylene (PTFE)—commonly sold under the trademark Teflon™—copper, brass, nylon, resinous plastic materials such as Delrin™, polycarbonate resins such as Lexan™, various aluminum compositions (e.g. types 1100, 2024, 3003, 5052, 6061, and 7075) and several types of steel. Examples of steel types are mild steels (e.g. type 1018 cold rolled steel and A36 hot rolled steel), alloy steels (e.g. types 4130, 4140, 4142, 4340, 5160, 6150, 8630 and 86L20 leaded steel alloy), stainless steels (e.g. types 301, 302, 303, 304, 316, 321, 347, 410, 416, 17-4 and 17-7), and tool steels (e.g. types O-1, A-2, D-2, and W-2). In addition, certain tool steels may be heat treated to different hardness values, from soft to very hard. For example, type O-1 tool steel may be heat treated to Rockwell hardness values 10, 20, 30, 40, 50 and 60. Other materials may be employed, as desired.

FIGS. 4–7 illustrate alternate mechanical arrangements for removably securing a ball striking insert 25 to the putter body 10 within the recess 22. In the embodiment illustrated in FIG. 4, the ball striking insert 25 is provided with a pair of rearwardly extending studs 31 which extend through through apertures 33 formed in putter body 10 (illustrated as rectangular for simplicity) and releasably engaged by spring nuts 35.

Figure 5:
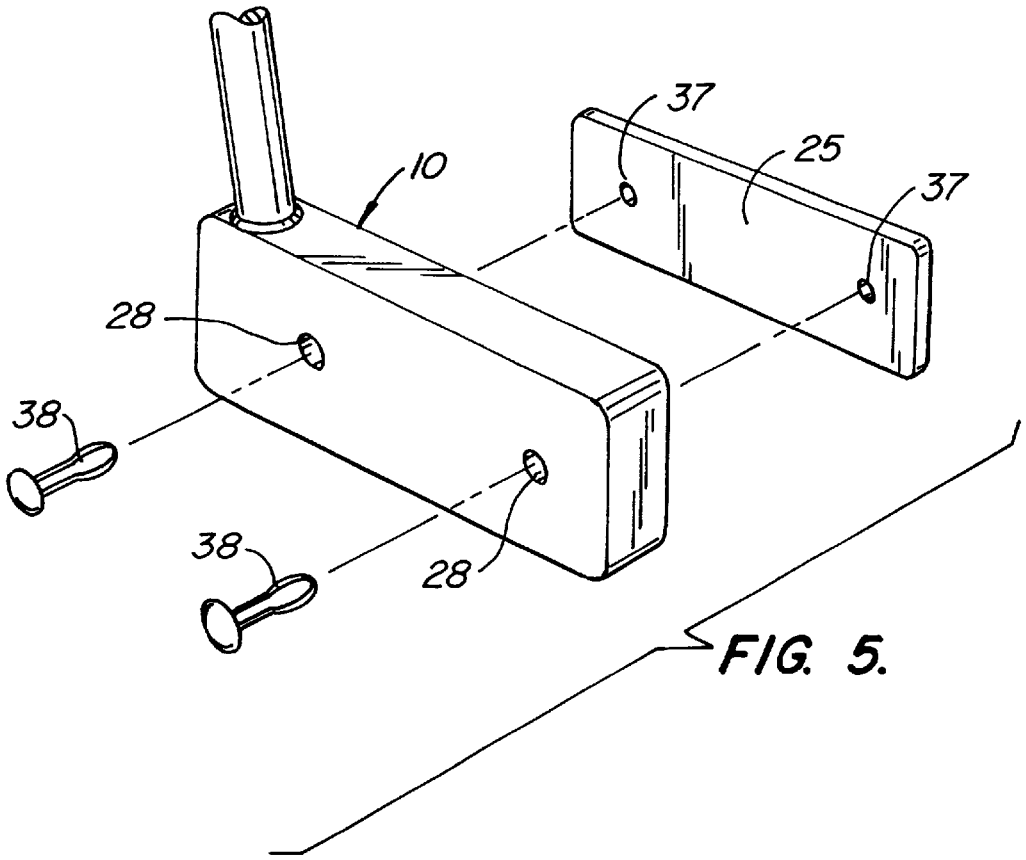

In the embodiment shown in FIG. 5, the ball striking insert 25 is provided with blind bores 37 (which may also be through bores), and a pair of male spring bayonet fasteners 38 are maneuvered through through apertures 28 in putter body 10 and into retaining bores 37, so that the ball striking insert 25 is retained by the spring-like frictional engagement between the outer walls of fasteners 38 and the surface walls of bores 37.

Figure 6:
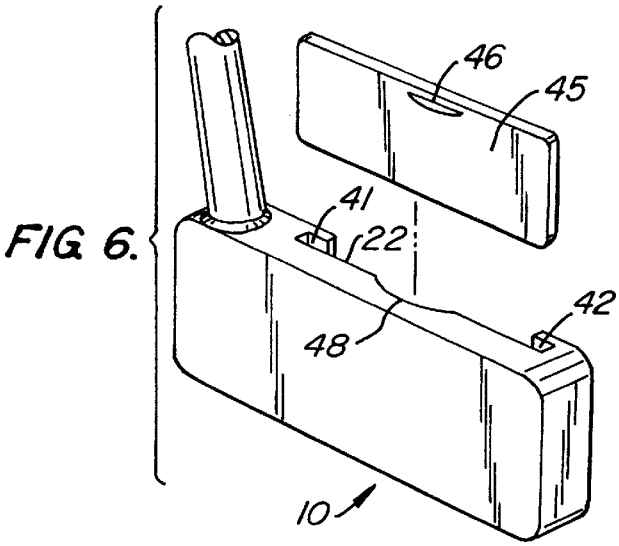
Figure 7:
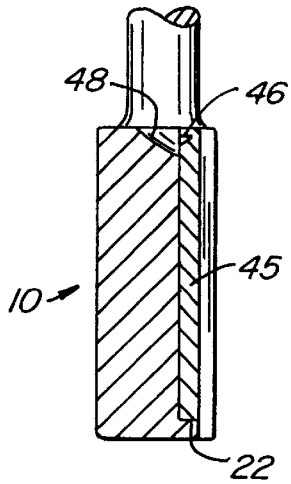
FIG. 7 is a sectional view of an assembled insert and putter body of the type shown in FIG. 6.

In the embodiment shown in FIGS. 6 and 7, putter body 10 is provided with a pair of vertically arranged slotted apertures 41, 42 at each end of recess 22 in which the lateral ends of the ball striking insert 45 can be slidably engaged. The dimensions of the slots 41, 42 and the ball striking insert 45 should be chosen such that a relatively tight frictional fit is achieved so that the ball striking insert 45 does not slip or slide once installed in the putter body 10. If desired, an additional retaining force may be provided using a releasable adhesive or a magnetic element (e.g., a magnetizable component may be added to the composition of the material comprising insert 25). To facilitate removal, the rear surface of ball striking insert 45 is indented as at 46 near the upper margin thereof, and the upper edge of the recess is slightly relieved as at 48 so that a thumb nail, the tip of a golf tee, or the tip of some other tool can engage the recess 46 and facilitate the transfer of an upward pulling force to the ball striking insert 45.

Figure 8:
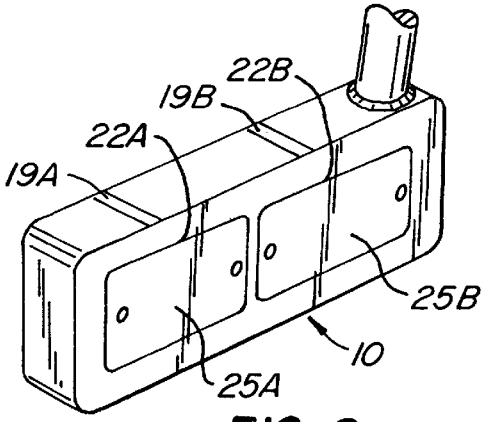
FIG. 8 is a perspective view of a dual insert embodiment of the invention.

FIG. 8 illustrates another embodiment of the invention in which a pair of ball striking inserts 25*a*, 25*b* are removably installed in a pair of laterally spaced recesses 22*a*, 22*b*. Recesses 22*a*, 22*b* may be formed to the same or different depths and may have the same or different length and width dimensions, depending upon whether identically sized or different sized inserts 25 are to be used. In this embodiment, inserts having different characteristics can be carried by the same putter body 10, and the golfer may putt with either insert by aligning either insert 25*a* or 25*b* with the ball being played. If desired, a pair of indicia 19A, 19B may be provided in a visible location on the putter body 10, such as along the top surface thereof as illustrated in FIG. 8, to assist the golfer in aligning the center of the inserts 25*a*, 25*b* with the golf ball.

The purpose of providing the interchangeable inserts 25 is to permit the golfer to vary the playing characteristics of the club. By providing inserts of different weights, the swing weight of the putter can be varied. By providing inserts having different surface textures, the frictional interaction between the putter and the ball can be varied. By providing inserts 25 of different hardnesses, the momentum transfer between the putter and the club may be varied. Thus, the golfer using a putter fabricated according to the invention may collect a family of inserts 25, and may classify the entire collection into subcategories of preferred inserts for varying golf course conditions, depending on the type of grass of which the greens are composed, speed of the greens, and other subtle factors.

Figure 9:
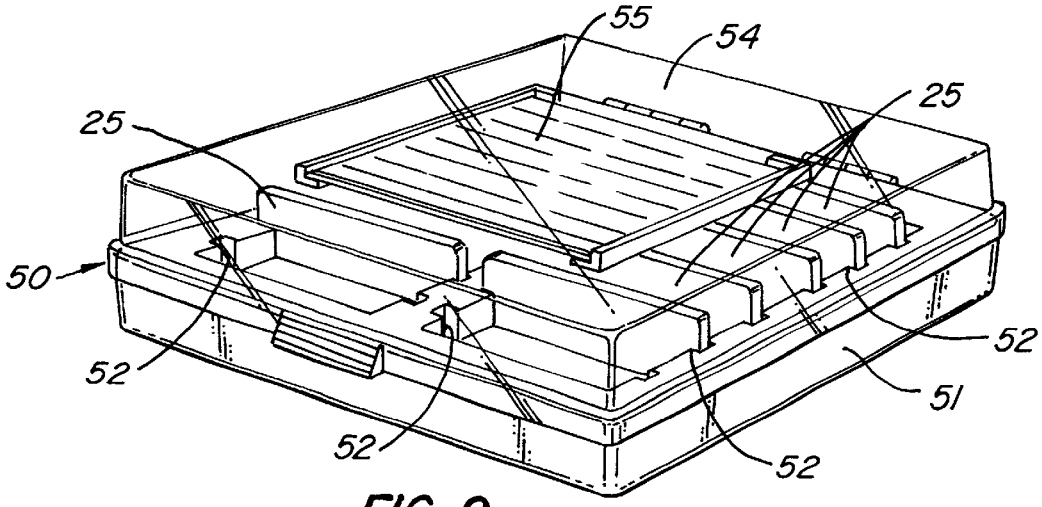
FIG. 9 is a perspective view of an insert container.

FIG. 9 illustrates one embodiment of a point of sale package which also serves as a storage container for ball striking inserts 25 of various different types. As seen in this figure, the container 50 includes a base 51 provided with a plurality of insert holding recesses 52 for removably holding individual ball striking inserts 25. Mounted inside a cover 54, which is preferably transparent, is a journal card or booklet 55. Element 55 is preprinted with useful information pertaining to the individual inserts, such as identifying characters or indicia for each different type of ball striking insert 25, suggested uses of the different types of insert 25 (e.g. types of greens on which a given insert 25 may be recommended), a correlation between green speed and insert type, a correlation between types of golf balls (e.g. hard cover, soft cover) and types of insert 25, and any other useful information for the guidance of the golfer. Element 55 may also include a section serving as a diary in which the golfer may make personal notes or entries reflecting the golfer's experience using different types of insert 25 with different balls and varying greens conditions. Container 50 may be fabricated from any suitable materials, such as plastics of the type used to make container packages or blister packs, fine hardwoods, card board or metal, depending on the desired quality of presentation. Suitable indicia are provided adjacent the insert slots 52 which are correlated to the indicia provided in the element 55. For example, letters or numerals may be provided which are correlated to identical letters or numbers listed in element 55. Alternatively, the different types of insert 25 may be color coded, and the color codes used in element 55 to identify and characterize the types of insert 25. Although the container shown in FIG. 9 is illustrated as accommodating two columns of inserts 25, other configurations are envisioned for container 50, such as a single column, a triple column, radial slots 52 emanating from the center of the package, or an irregular arrangement of slots 52.

While the above provides a full and complete disclosure of the preferred embodiments of the invention, various modifications, alternate constructions and equivalents may be employed, as desired. For example, while specific materials have been identified for the fabrication of ball striking inserts 25, other materials will occur to those skilled in the art. Similarly, while ball striking inserts 25 and recess 22 have been described and illustrated as rectangular in shape, other geometrical shapes, such as elliptical, circular or the like may be employed, if desired. Also, other mechanical arrangements may be employed for detachably mounting inserts 25 to putter body 10, as desired. Therefore, the above description and illustrations should not be construed as limiting the scope of the invention, which is defined by the appended claims.

What is claimed is:

1. A golf club for putting comprising:

a putter body having a shaft connection region and a ball striking surface, said ball striking surface having a first recess formed therein to a first predetermined depth;

a shaft having an end secured to said shaft connection region; and a first ball striking insert detachably mounted in said recess, said insert having length, width and depth dimensions closely matching said recess so as to form a ball striking face substantially coplanar with said ball striking surface, whereby the putting characteristics of said golf club can be varied by using ball striking inserts of different weight, texture and hardness;

wherein said putter body is provided with an insert receiving slot adjacent said recess, and wherein said ball striking insert has a portion engageable with said slot.

2. A golf club for putting comprising:

a putter body having a shaft connection region and a ball striking surface, said ball striking surface having a first recess formed therein to a first predetermined depth;

a shaft having an end secured to said shaft connection region; and a first ball striking insert detachably mounted in said recess, said insert having length, width and depth dimensions closely matching said recess so as to form a ball striking face substantially coplanar with said ball striking surface, whereby the putting characteristics of said golf club can be varied by using ball striking inserts of different weight texture and hardness;

wherein said putter body has a spaced pair of insert receiving slots at opposite ends of said recess, and wherein said ball striking insert has opposite end portions each engageable with a different one of said slots.

3. The golf club of claim 1 wherein said putter body is provided with a relieved portion adjacent said recess to facilitate access to said grip recess.

4. A golf club for putting comprising:

a putter body having a shaft connection region and a ball striking surface, said ball striking surface having a first recess formed therein to a first predetermined depth and an insert receiving slot adjacent said recess;

a shaft having an end secured to said shaft connection region; and a first ball striking insert detachably mounted in said recess, said ball striking insert having a portion engagable with said slot, said insert having length, width and depth dimensions closely matching said recess so as to form a ball striking surface substantially co-planar with said putter body ball striking surface, said ball striking insert including a grip recess formed therein in a position accessible when said ball striking insert is mounted in said recess, whereby the putting characteristics of said golf club can be varied by using ball striking inserts of different weight, texture and hardness.

5. For use with a golf club for putting having a putter body with a ball striking surface and a recess formed in said ball striking surface, a ball striking insert having length, width and thickness dimensions closely matching the recess so as to form a ball striking face substantially co-planar with the ball striking surface when said insert is positioned in the recess, means for enabling said insert to be detachably mounted to the putter body, and a grip recess formed in said ball striking insert in a position accessible once said ball striking insert is mounted in said recess.

6. A golf club for putting comprising:

a putter body having a shaft connection region and a ball striking surface, said ball striking surface including a generally rectangular first recess formed therein to a first predetermined depth, said recess having top, bottom, left and right surfaces;

a shaft having an end secured to said shaft connection region; and a plurality of ball striking inserts each fabricated from a different material selected from the group consisting of titanium, graphite, PTFE, copper, brass, nylon, resinous plastic material, polycarbonate resin, aluminum and steel, each said ball striking insert adapted to be detachably mounted in said recess, said insert having length, width and depth dimensions closely matching said recess so as to form a ball striking face substantially coplanar with said ball striking surface, whereby the putting characteristics of said golf club can be varied by using ball striking inserts of different weight, texture and hardness.

* * * * *